US007168261B2

(12) United States Patent
Grewal et al.

(10) Patent No.: US 7,168,261 B2
(45) Date of Patent: Jan. 30, 2007

(54) ICEMAKER ADAPTER

(75) Inventors: Randeep S. Grewal, San Antonio, TX (US); Harlan R. Davis, San Antonio, TX (US)

(73) Assignee: Lancer Partnership, Ltd, San Antonio, TX (US)

( * ) Notice: Subject to any disclaimer, the term of this patent is extended or adjusted under 35 U.S.C. 154(b) by 156 days.

(21) Appl. No.: 11/010,886

(22) Filed: Dec. 13, 2004

(65) Prior Publication Data

US 2006/0060605 A1 Mar. 23, 2006

Related U.S. Application Data

(60) Provisional application No. 60/612,401, filed on Sep. 23, 2004.

(51) Int. Cl.
*F25C 1/00* (2006.01)

(52) U.S. Cl. ..... 62/340; 62/389; 248/346.07

(58) Field of Classification Search ..... 62/66–74, 62/298, 340–356, 389–400; 248/346.07
See application file for complete search history.

(56) References Cited

U.S. PATENT DOCUMENTS 2,028,098 A * 1/1936 Zafuta ..... 222/130
2,266,766 A * 12/1941 Knight ..... 62/258
5,722,244 A * 3/1998 Shelton ..... 62/74
5,987,900 A * 11/1999 Love ..... 62/66
6,203,031 B1 * 3/2001 Leverington ..... 280/35
6,343,481 B2 * 2/2002 Simmons et al. ..... 62/298
6,761,036 B2 * 7/2004 Teague et al. ..... 62/70
6,820,850 B2 * 11/2004 Coleman ..... 248/346.07
6,880,358 B2 * 4/2005 Lucas et al. ..... 62/344
2004/0221608 A1 * 11/2004 Jablonski ..... 62/344
2004/0263036 A1 * 12/2004 Zizas ..... 312/404

* cited by examiner

*Primary Examiner*—William E. Tapolcai
(74) *Attorney, Agent, or Firm*—Christopher L. Makay

(57) ABSTRACT

An icemaker adapter is suitable for use with different beverage dispensers available from different beverage dispenser manufacturers. The icemaker adapter includes a first member movably engaged with a second member, and a passage therebetween. The first and second members move toward or away from each other to adjust for a dispenser depth dimension. In use, the icemaker adapter resides on top of a beverage dispenser and above a storage chamber of the beverage dispenser. An icemaker is mounted onto a top portion of the icemaker adapter, such that ice from a dispensing zone of the icemaker falls through the passage to a storage chamber of the beverage dispenser. In alternative embodiment, the icemaker adapter adjusts for a side-to-side dimension of the beverage dispenser. In still another embodiment, the icemaker adapter adjusts in two perpendicular directions to accommodate by a width and a depth of the beverage dispenser.

19 Claims, 5 Drawing Sheets

ICEMAKER ADAPTER

RELATED APPLICATION

The present application claims all available benefit, under 35 U.S.C. 119(e), of U.S. provisional patent application Ser. No. 60/612,401, filed Sep. 23, 2004. By this reference, the full disclosure of U.S. provisional patent application Ser. No. 60/612,401 is incorporated herein as though now set forth in its entirety.

BACKGROUND OF THE INVENTION

1. Field of the Invention

The present invention relates to adapting icemakers to beverage dispensers and, more particularly, but not by way of limitation, to methods and an apparatus for an icemaker adapter.

2. Description of the Related Art

In the areas of food and beverage dispensing, manufacturers are often forced to provide a variety of dispenser sizes and capacities to accommodate customer requirements. Beverage dispenser manufacturers also typically have optional equipment that may be utilized in alternate configurations. The presence of these multiple configurations suggests that the sales force must be intimately familiar with the product lines, the limitations of the product lines, as well as variations thereof.

Purchasers of larger volumes of beverage dispensing equipment must also become familiar with the product lines of the suppliers, such that they may effectively purchase the correct equipment for placement into proper consumption sites. The plight of the purchasing entity is complicated, as there may be multiple suppliers with similar but incompatible equipment. Purchasers must be aware of the compatibilities to ensure that incompatible equipment is not shipped to a consumption location for use together, as doing so would most likely limit the beverage dispensing capabilities of the establishment, if they are not completely disabled.

Streamlining of the purchasing process results in the consolidation of some components to reduce the quantity of catalogue items available. Consolidation of products within a single organization is easily achievable. Consolidation of products across competitor lines, however, may prove more difficult, as competitors do not regularly share information or charters. Accordingly, hardware that is adaptable to virtually all supplier beverage dispensers, illustratively an ice maker adapter, would be beneficial to the larger volume purchasers, as well as those vying to reduce the number of catalogue items in a purchasing database.

SUMMARY OF THE INVENTION

In accordance with the present invention, an icemaker adapter provides the ability to reduce the number of inventory items in a purchasing database. The icemaker adapter is suitable for use with different beverage dispensers available from different beverage dispenser manufacturers. This practice removes the possibility of ordering an icemaker adapter that is incompatible with a particular beverage dispenser, as well as the risk associated with incompatible parts being shipped to customer sites for use.

The icemaker adapter includes a first member movably engaged with a second member. The first and second members move toward or away from each other to adjust for a dispenser depth dimension. The icemaker adapter further comprises a passage created between the first and second members for the passage of ice from an icemaker to a storage chamber of a beverage dispenser. In alternative embodiment, the icemaker adapter adjusts for a side-to-side dimension of the beverage dispenser. In still another embodiment, the icemaker adapter adjusts in two perpendicular directions to accommodate by a width and a depth of the beverage dispenser.

It is therefore an object of the present invention to provide an icemaker adapter that adjusts for a varying depth of the beverage dispensers currently available in industry.

It is a further object of the present invention to provide an icemaker adapter that adjusts for a varying width of the beverage dispensers currently available in industry.

It is still further an object of the present invention to provide an icemaker adapter that adjusts for varying widths and depths of beverage dispensers currently available in industry.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

An icemaker adapter provides buyers of beverage dispensing equipment with the capability to specify an icemaker adapter that is compatible with beverage dispensers from varying major brands. The icemaker adapter is also compatible with virtually all icemaker brands and icemaker sizes that may be used with the particular beverage dispenser. The icemaker adapter is adjustable to successfully move from a first position compatible with a first brand of beverage dispenser to a second position compatible with a second brand of beverage dispenser, or any position there between.

Figure 1:
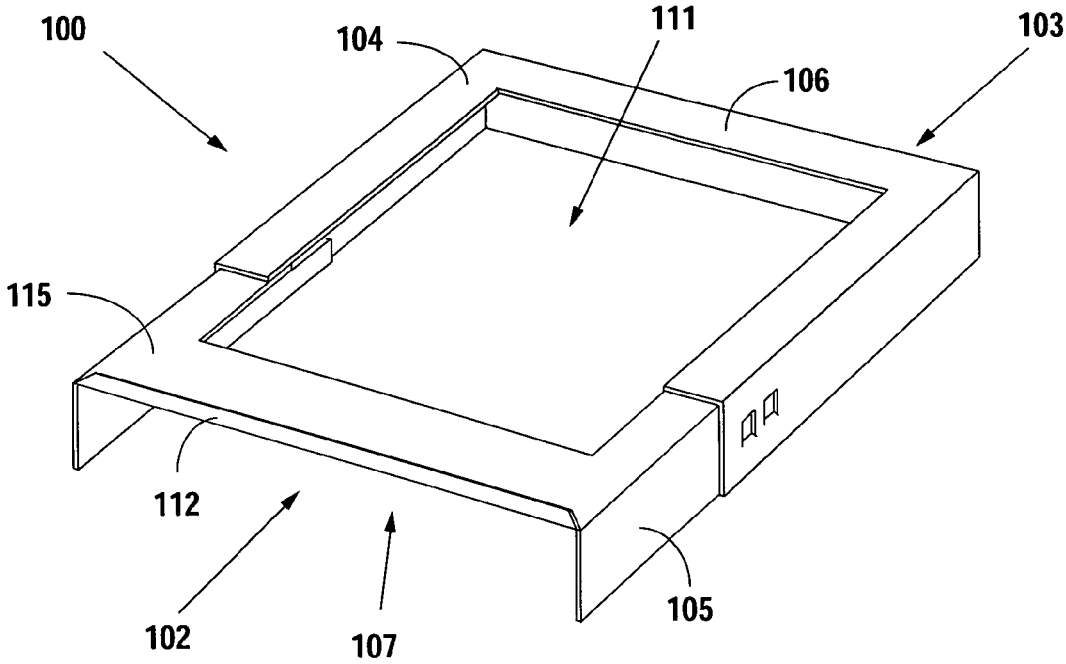
FIG. 1 provides a perspective view of an icemaker adapter according to the preferred embodiment.
Figure 2:
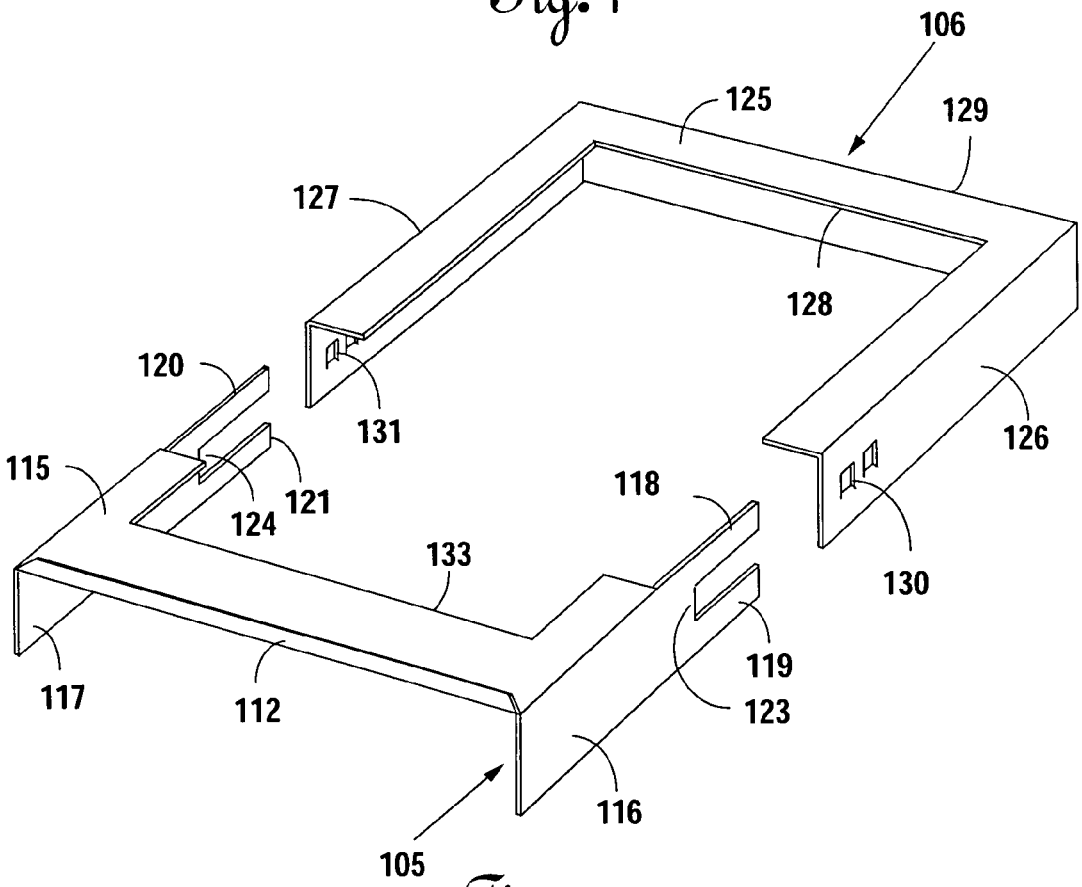
FIG. 2 provides an exploded view of the icemaker adapter according to the preferred embodiment.
Figure 3:
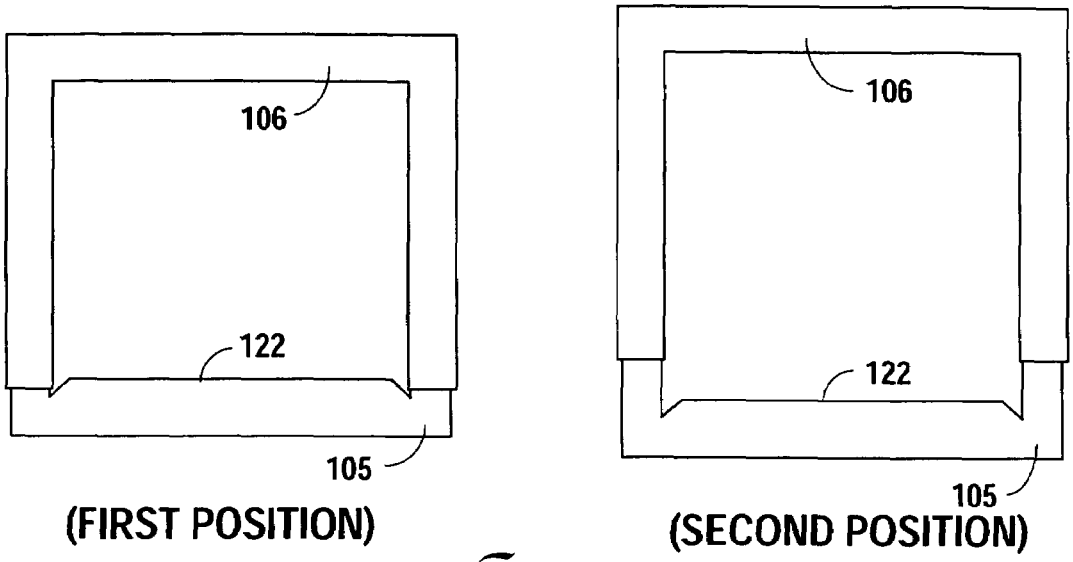
FIG. 3 provides a top view of the icemaker adapter according to the preferred embodiment in a first and a second position according to the preferred embodiment.

As shown in FIGS. 1–3, an icemaker adapter 100 includes a first member 105, a second member 106, and an open end 102. In the assembled form, the icemaker adapter 100 includes a passage 111 passing from a top 104 to a bottom 107. The first member 105 is slightly narrower than the second member 106, such that it may be positioned in front of the second member 106 and slid within the second member 106. The first member 105 is of a sheet metal construction, preferably stainless steel, however, one of ordinary skill in the art will recognize that other materials suitable for use in an ice contact dispenser environment may be utilized, including plastics. The first member 105 includes a top face 115, a first flange 116, and a second flange 117. The top face 115 includes a recessed portion 133. A front edge of the recessed portion 133 includes a containment lip 122 that directs falling objects away from the open end 102 of the icemaker adapter 100. The first and second flanges 116 and 117 protrude past the top face 115. The first flange 116 includes a first engagement tang 118, a first support tang 119, and a first stop 126. Similarly, the second flange 117 includes a second engagement tang 120, a second support tang 121, and a second stop 124. A lip 112 protrudes upward from a forwardmost edge of the top face 115.

The second member 106 is also of a sheet metal construction, preferably stainless steel, and includes a top face 125, a first flange 126, a second flange 127, and a third flange 129. The first, second, and third flanges 126, 127, and 129 protrude downward from the top face 125, thereby creating an enclosure having three sides and a top. The top face 125 includes a recessed portion 128. The recessed portion 128 is substantially centrally located within the top face 125, such that the top face 125 retains a minimum width along each flange 126, 127, and 129 to properly support any items placed on the top face 125. The first and second flanges 126 and 127 include a pair of tang receivers 130 and 131, respectively. The tang receivers 130 and 131 in this embodiment are features punched from the sheet metal, illustratively die cut and formed features to create a channel shaped support throughout the length of the tang receivers 130 and 131. The tang receivers 130 and 131 protrude inward to accept the tangs 118 and 120 of the first member 105 during assembly. While this embodiment has been shown with tang receivers 130 and 131, it should be clear to one of ordinary skill in the art that various methods for engagement and support may be utilized, including fasteners, adhesives, welding, or other sheet metal features commonly utilized in the industry.

Upon assembly, the tangs 118, 119, 120, and 121 of the first member 105 are placed within the first and second flanges 126 and 127, and below the top face 125 of the second member 106. With the top faces 115 and 125 of the first and second members 105 and 106 facing upward, the first and second engagement tangs 118 and 120 will enter the tang receivers 130 and 131, respectively, when the first and second members 105 and 106 are assembled. The first member 105 will continue to move into the second member 106 until the first and second stops 123 and 124 contact the tang receivers 130 and 131 closest to the open end 102 of the first member 105. In this configuration, the recessed portion 133 of the first member 105 and the recessed portion 128 of the second member 106 align to form the passage 111. The first and second members 105 and 106 may be slidably moved forward or backward to complement an upper portion of a beverage dispenser.

As shown in FIG. 3, the icemaker adapter 100 may be adjusted to accommodate a multitude of positions for a particular width of a dispenser, including a first position, a second position, positions between the first and second positions, as well as positions beyond the first and second positions. One of ordinary skill in the art will recognize that the range of use is directly related to the length of the engagement tangs 118 and 120, and the location of the tang receivers 130 and 131. It should further be recognized that the icemaker adapter 100 may be constructed with a hole pattern, detents, or any other form of locating feature. The passage 111 of the icemaker adapter 100 is suitable for receiving ice from a drop zone of any icemaker commonly utilized with a particular size beverage dispenser, however one of ordinary skill in the art will further recognize that the recessed portions 133 and 128 of the first and second members 105 and 106 may be adjusted to accommodate newer versions of icemakers and icemaker drop zone changes.

In use, the icemaker adapter 100 is placed on top of a beverage dispenser 110. As one of ordinary skill in the art will recognize, beverage dispensers 110 are readily known and commonly available. In this disclosure, beverage dispensers 110 are defined to dispense various forms of beverages, including soft drinks, uncarbonated drinks, water, flavored drinks, and concentrates thereof. The beverage dispenser 110 in this embodiment includes a rear wall 140, a front wall 139, a first sidewall 141, and a second sidewall 142. The beverage dispenser 110 further includes a storage chamber 145 disposed within the walls 139, 140, 141, and 142, and dispensing nozzles 148 disposed on an exterior portion of the front wall 139. The storage chamber 145 is typically utilized to store a product for dispensing, illustratively ice, and may include an upper face 143 that rides along the uppermost edges of the dispenser walls 139, 140, 141, and 142. The beverage dispenser 110 may still further include a dispensing port 146 and an actuation lever 147 for receiving the signal to move the product from the storage chamber 145 to the dispensing port 146 for use.

Figure 4:
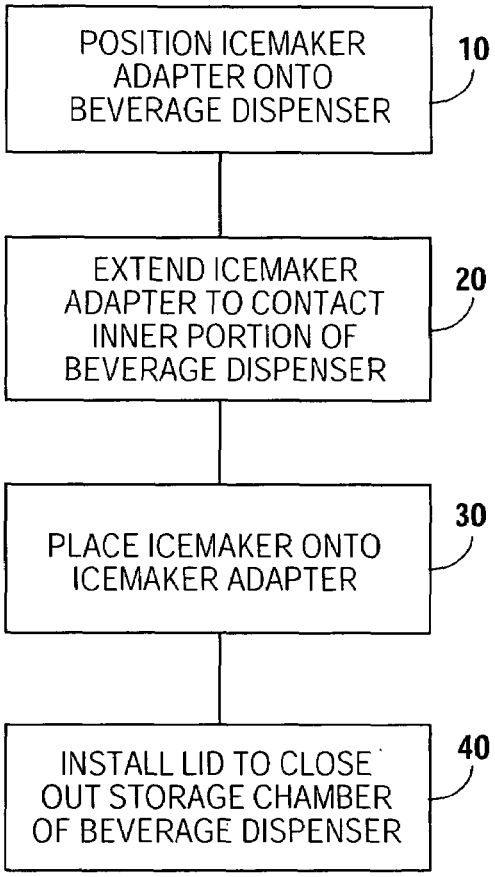
FIG. 4 provides a method flowchart illustrating a method of use for the icemaker adapter.
Figure 5A:
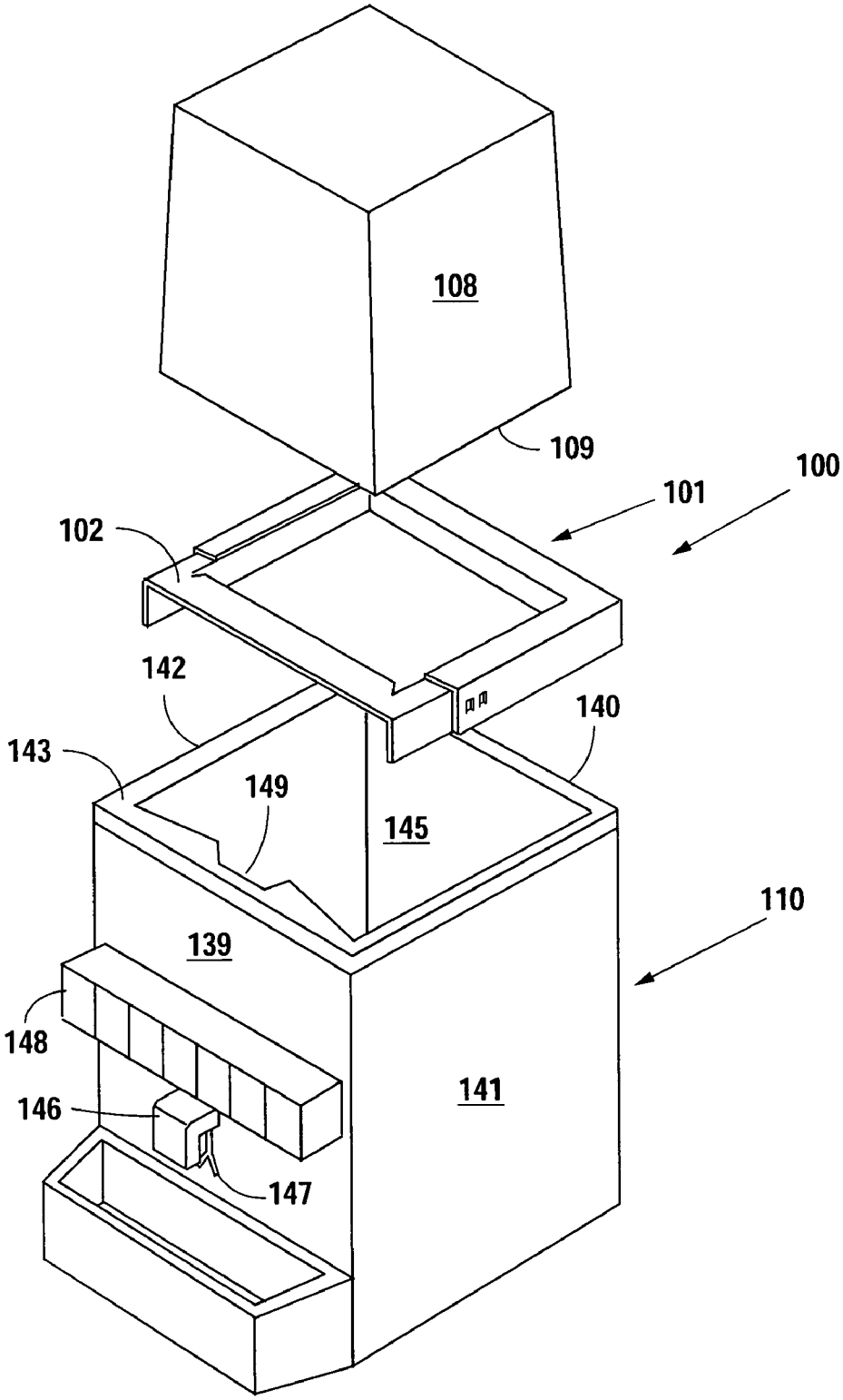
FIG. 5*a* provides an exploded view of a beverage dispenser and an icemaker in combination with an icemaker adapter according to the preferred embodiment.
Figure 5B:
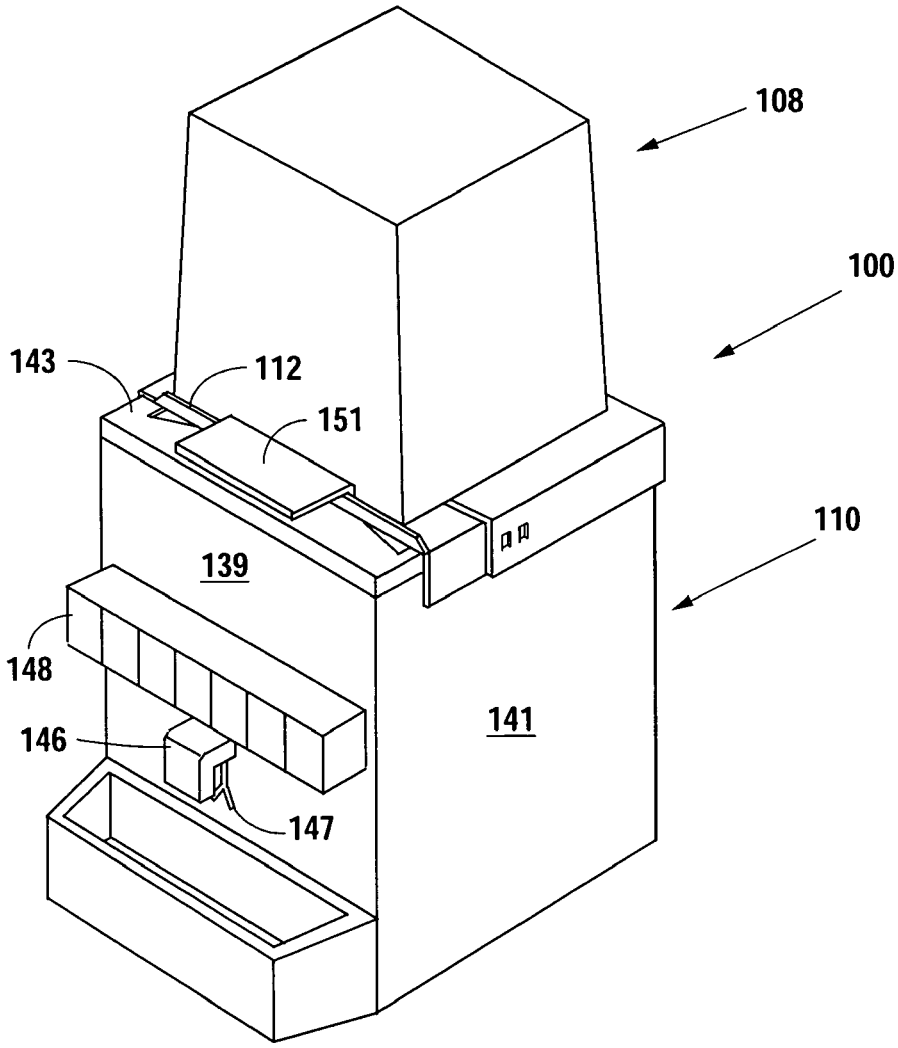
FIG. 5*b* provides a view of the icemaker adapter in use according to the preferred embodiment.

Installation of the icemaker adapter 100 begins by placing the icemaker adapter 100 onto the upper face 143 of the beverage dispenser 110 as shown in step 10 of the method flowchart of FIG. 4. The universal icemaker adapter 100 is oriented on the beverage dispenser 110, such that the third flange 129 of the second member 106 is adjacent to an upper portion of the rear wall 140 of the dispenser 110, and the flanges 116, 117, 126, and 127 are adjacent to the side walls 141 and 142 of the beverage dispenser 110. In this position, the containment lip 122 protrudes downward into the storage chamber 145. The process continues with step 20, wherein the operator extends the icemaker adapter 100 by pulling the first member 105 away from the second member 106 until the first member 105 engages part of the front wall 139 or an inner portion of the storage chamber 145.

Once the icemaker adapter 100 has been extended, an icemaker 108 is placed on top of the icemaker adapter 100, step 30, such that a dispensing zone 109 lies above the passage 111, and ice dispensed from the icemaker 108 falls through the passage 111 to enter the storage chamber 145. The icemaker 108 may be secured to the adapter assembly or may be restrained with an anti-slide mechanism (not shown) to minimize the possibility of the icemaker 108 falling from the top of the beverage dispenser 110.

In the installed position, the access port 149 is unobstructed, such that an operator may scoop ice manually or to provide access for cleansing operations. The access port 149 may be covered with a lid 151, step 40, to close out the storage chamber 145 area. A rear edge of the lid 151 may rest on the lip 112 in the installed position to provide easy access to the storage chamber 145. While this lid 151 has been shown to cover only the access port 149, it should be clear to one of ordinary skill in the art that the lid 151 may run the full length of the beverage dispenser 110 to properly close out the storage chamber 145.

Figure 6:
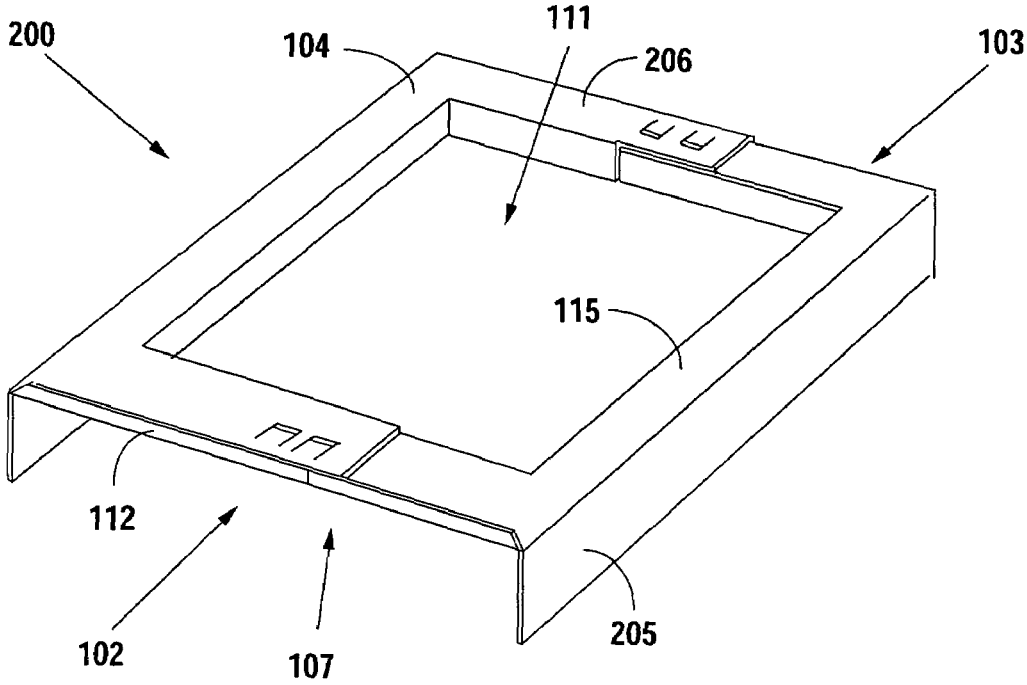
FIG. 6 provides a perspective view of a second embodiment having a side-to-side adjustment.

While this icemaker adapter 100 has been shown to adjust from a front to a rear, it should be clear to one of ordinary skill in the art that the principles involved in adjusting a front to rear width may be applied to a side-to-side dimension. As shown in FIG. 6, an icemaker adapter 200 includes a first member 205 and a second member 206, and is adjustable in a side-to-side direction. This type of adjustment provides for adjustment to an unlimited number of positions between the engagement point of the first and second members 205 and 206, to a closest allowable position. Adjustment in a side-to-side direction accommodates varying widths of different beverage dispensers. The icemaker adapter 200 retains the most features of the previous embodiment, including a passage 111 for the movement of product. The first member 205 and the second member 206 of the icemaker adapter 200 may slidably engage each other using any suitable method of retention and adjustment as disclosed in the icemaker adapter 100 to adapt to a top portion of a beverage dispenser.

Figure 7:
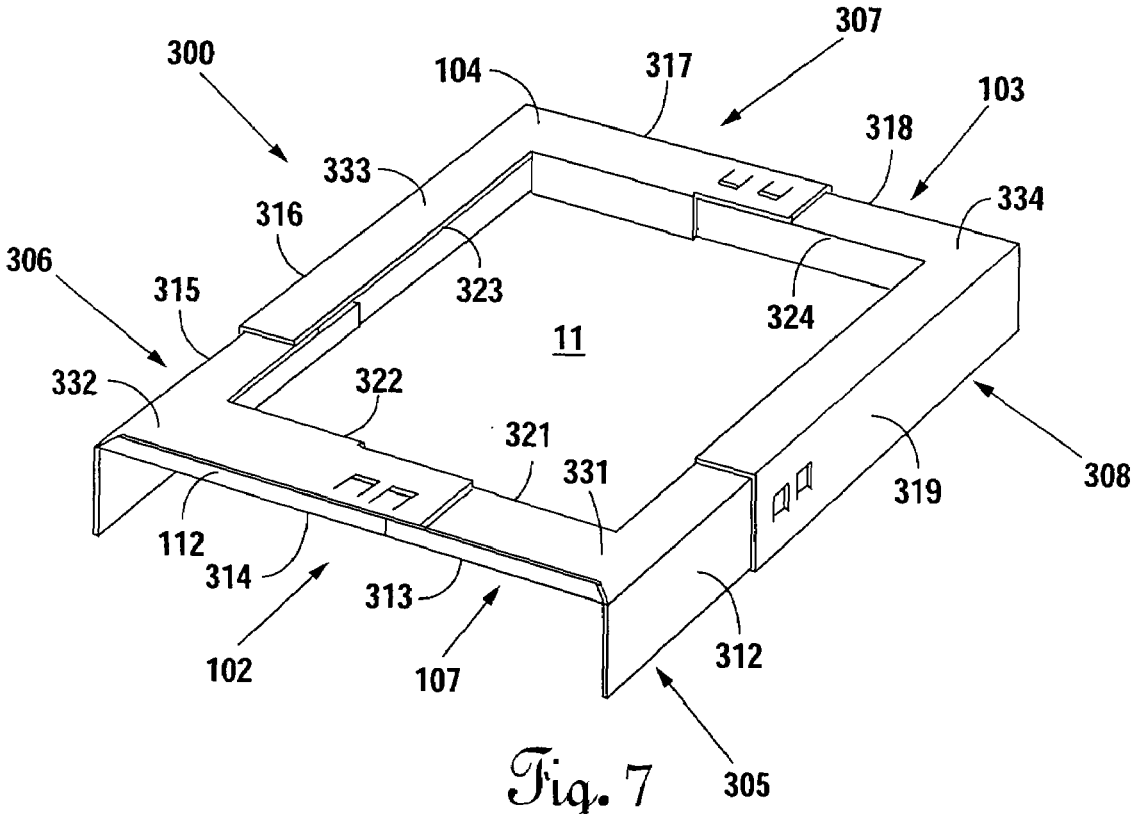
FIG. 7 provides a perspective view of a third embodiment having both a side-to-side and a front-to-rear adjustment.

As the icemaker adapter 100 and icemaker adapter 200 have been shown to adjust for front to rear dimensions and side-to-side dimensions of beverage dispensers, respectively, it should be clear to one of ordinary skill in the art that the combination of the two directions of adjustment provides an adapter that is suitable for use with a wider range of beverage dispenser sizes. As shown in FIG. 7, an icemaker adapter 300 includes a first member 305, a second member 306, a third member 307, and a fourth member 308. The first member 305 includes a first end 312, a second end 313, and a top face 331 having a recessed portion 321. The second member 306 includes a first end 314, a second end 315, and top face 332 having a recessed portion 322. The third member 307 includes a first end 316, a second end 317, and top face 333 having a recessed portion 323. The fourth member 308 includes a first end 318, a second end 319, and a top face 334 having a recessed portion 324.

In this embodiment the first end 312 of the first member 305 is movably connected to the second end 319 of the fourth member 308 and the first end 314 of the second member 306. Likewise, the first end 316 of the third member 307 is movably connected to the second end 315 of the second member 306, and the second end 317 of the third member 307 is movably connected to the first end 318 of the fourth member 308. The movable joints of the icemaker adapter 300 may be of any suitable connection means, including stamped features, fasteners in a hole pattern, slots, and the like, that allow the members 305, 306, 307, and 308 to move toward or apart from each other. When assembled, the recessed portions 321, 322, 323, and 324 of the four members 305, 306, 307 and 308, respectively, combine to create a passage 111. The passage 111 allows products to move from a top 104 of the icemaker adapter 300 to a bottom 107 of the icemaker adapter 300. All other operations of the icemaker adapter 300 are similar to those disclosed in the previous embodiments. While the icemaker adapter 300 adjusts in two perpendicular directions to accommodate first an exterior beverage dispenser dimension and then a rear to front interior dimension, one of ordinary skill in the art will recognize that different designs may require different methods of engagement.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A beverage dispensing station, comprising:

a beverage dispenser comprising a storage chamber and a beverage dispensing circuit;

an icemaker adapter disposed on top of the beverage dispenser, the icemaker adapter comprising a first member movably engaged to a second member and a passage; and an icemaker disposed on top of the icemaker adapter, such that ice from the icemaker exits the icemaker and passes through the passage of the icemaker adapter to enter the storage chamber of the beverage dispenser for storage.

2. The beverage dispensing station according to claim 1, wherein the first member and the second member are slidably engaged to accommodate a range of beverage dispenser sizes.

3. The beverage dispensing station according to claim 2, wherein the first member of the icemaker adapter includes engagement tangs, and the second member includes tang receivers for accepting the engagement tangs, such that the engagement tangs may slide along the tang receivers to adjust the size of the icemaker adapter.

4. The beverage dispensing station according to claim 1, wherein the icemaker adapter adjusts to accommodate different size beverage dispensers.

5. The icemaker adapter according to claim 4, wherein first member adjusts to accommodate a front to back dimension of a beverage dispenser.

6. The icemaker adapter according to claim 4, wherein the first member adjusts to accommodate a side-to-side dimension of a beverage dispenser.

7. The beverage dispensing station according to claim 1, wherein the first member includes a recessed portion.

8. The beverage dispensing station according to claim 7, wherein the second member includes a recessed portion.

9. The beverage dispensing station according to claim 8, wherein the recessed portion of the first member and the recessed portion of the second member form the passage in the icemaker adapter.

10. The beverage dispensing station according to claim 1, further comprising:

a lid disposed on the beverage dispenser to close out the storage chamber of the beverage dispenser.

11. A beverage dispensing station, comprising:

a beverage dispenser comprising a storage chamber and a beverage dispensing circuit;

an icemaker adapter disposed on top of the beverage dispenser, the icemaker adapter having a passage therethrough, wherein the icemaker adapter adjusts to accommodate at least one dimension of the beverage dispenser; and an icemaker disposed on top of the icemaker adapter, such that ice from the icemaker adapter exits the icemaker and passes through the passage of the icemaker adapter to enter the storage chamber of the beverage dispenser for storage.

12. The beverage dispensing station according to claim 11, wherein the icemaker adapter adjusts to accommodate a front-to-rear dimension of the beverage dispenser.

13. The beverage dispensing station according to claim 12, wherein the icemaker adapter adjusts to accommodate a side-to-side dimension of the beverage dispenser.

14. The beverage dispensing station according to claim 13, wherein the icemaker adapter comprises a first member movably coupled to a second member.

15. The beverage dispensing station according to claim 14, wherein the icemaker adapter further comprises a third member movably coupled to the second member.

16. The beverage dispensing station according to claim 15, wherein the icemaker adapter still further comprises a fourth member movably coupled to the third member and the first member.

17. The beverage dispensing station according to claim 16, wherein the first member is slidably engaged with the second member and the fourth member to provide adjustment.

18. The beverage dispensing station according to claim 17, wherein the third member is slidably engaged with the second member and the fourth member to provide adjustment.

19. The beverage dispensing station according to claim 11, further comprising:

a lid disposed on the beverage dispenser to close out the storage chamber of the beverage dispenser.

* * * * *